US008337119B2

(12) United States Patent
Burnes et al.

(10) Patent No.: US 8,337,119 B2
(45) Date of Patent: Dec. 25, 2012

(54) LEACHING CHAMBER HAVING A DOME SHAPED END PORTION FOR PIVOTABLY CONNECTING WITH A SECOND CHAMBER END PORTION

(75) Inventors: James J. Burnes, Deep River, CT (US); Ronald Brochu, Westbrook, CT (US); Bryan A. Coppes, Old Saybrook, CT (US); Donald Crescenzi, Killingworth, CT (US); Michael J. Ambrosino, Cape Neddick, ME (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 344 days.

(21) Appl. No.: 12/012,396

(22) Filed: Jan. 31, 2008

(65) Prior Publication Data

US 2008/0124177 A1 May 29, 2008

Related U.S. Application Data

(63) Continuation of application No. 10/442,810, filed on May 20, 2003, now Pat. No. 7,351,006.

(60) Provisional application No. 60/382,144, filed on May 20, 2002.

(51) Int. Cl.
*E02B 11/00* (2006.01)

(52) U.S. Cl. ..... 405/46; 405/49

(58) Field of Classification Search ..... 405/43, 405/44, 45, 46, 47, 48, 49; 210/170.01, 170.03, 210/170.07; D25/16, 17, 18, 20, 36
See application file for complete search history.

(56) References Cited

U.S. PATENT DOCUMENTS

| | | | | |
|---|---|---|---|---|
| 4,245,924 | A * | 1/1981 | Fouss et al. | 405/45 |
| 5,588,778 | A * | 12/1996 | Nichols et al. | 405/48 |
| 5,669,733 | A * | 9/1997 | Daly et al. | 405/48 |
| 6,270,287 | B1 * | 8/2001 | Gray | 405/100 |
| 6,375,388 | B1 * | 4/2002 | Zoeller et al. | 405/43 |
| 6,592,293 | B1 * | 7/2003 | Hedstrom et al. | 405/48 |
| 2004/0101369 | A1 * | 5/2004 | DiTullio | 405/49 |

* cited by examiner

*Primary Examiner* — Michael Safavi
(74) *Attorney, Agent, or Firm* — Steven M. McHugh

(57) ABSTRACT

Arch shape cross-section leaching and stormwater chambers are connected together so that swiveled angling is obtained at the joint. Angling is accomplished by means of an integral or detachable dome end comprising a conical section. A like chamber with an ordinary end mates by overlapping the dome. Or a like chamber may have an opposing and overlapping end, which also comprises a dome. A coupling for connecting two ordinary end chambers is comprised of two spaced apart conical domes spaced apart by a connector. The connector between the domes is optionally straight or angled. The couplings enable chambers to be connected at diverse angles to each other, as well as to be connected parallel with offset, i.e., with zigzag path.

11 Claims, 8 Drawing Sheets

LEACHING CHAMBER HAVING A DOME SHAPED END PORTION FOR PIVOTABLY CONNECTING WITH A SECOND CHAMBER END PORTION

RELATED APPLICATIONS

This application is a continuation of U.S. patent application Ser. No. 10/442,810 filed May 20, 2003 now U.S. Pat. No. 7,351,006 and claims benefit of U.S. patent application Ser. No. 10/442,810 and Provisional Patent Application Ser. No. 60/382,144, filed May 20, 2002, the contents of which are incorporated herein by reference in their entireties.

TECHNICAL FIELD

The present invention relates to molded plastic stormwater and leaching chambers, for receiving and discharging storm water and wastewater underground.

BACKGROUND

Molded plastic leaching chambers are widely used for dispersing wastewater into soil and other media. Typically, a trench is cut in soil, and a string of interconnected straight 4 to 8 foot long arch shape cross section chambers is buried in the soil. Typically, the chambers have mating ends, and the end of a second chamber overlaps and or latches to the end of a first chamber. In common leaching systems water flows within the chambers by gravity. Thus, a string of chambers must have a slight pitch with respect to the horizontal plane, so the wastewater flows from one end of the string to the other. Whenever possible, chamber strings run along a more or less straight line.

When a string of chambers is installed on a sloping piece of land, the usual aim will be to run the strings of chambers transverse to the direction of the slope. Often, this demands that the string follow a curving or serpentine path, along the curving contour of a hillside. There are other instances where strings of chambers must follow a not straight path. For instance, an obstruction such as a boulder or other object may be encountered. Then, what would have desirably been a straight string must instead follow a deviating path, to pass around the obstruction. Thus, there has been a continuing need for connecting together chambers so that a chamber string approximates a curve in various degrees.

In most commercial chambers the fit at the joint between chambers is loose enough to allow some angling between chambers, so the string can follow a curving path. However, usually the amount of angling at each chamber is a few degrees at best, e.g. plus or minus 3 degrees. When more curving has been needed, various approaches are taken. A common solution has been to fit chambers with end plates which accept pipes, and connect adjacent chambers with pipes and common angled plumbing elbows. However, this entails an associated cost of additional parts and labor. Another approach has been to provide chambers with preformed angled ends. See U.S. Pat. No. 5,588,788 to Nichols and U.S. Pat. No. 5,669,733 to Daly et al. Analogously, short angled adapters, shaped in cross section like chambers, have been used. However, when using angled chambers and adapters it is a problem to have on hand the right chamber angle for the particular use. The need for chambers and adapters with different end angles raises plastic molding die costs and costs and nuisance of carrying inventory within the chamber distributor system and end user system.

Thus, there is a need for a means for connecting chambers at a chosen angle, according to the instant demand during a field installation. In some applications relatively small angles of adjustment are sought; in other instances there is a desire for a large range of angling, up to 90 degrees plus or minus. While the primary need is for leaching chambers, there is a use for angling of chambers used in other applications, such as for handling storm waters, or for chambers which provide voids within the earth for other reasons. Any means, whether a separate unit, or integral with the chamber, must have performance consistent with that demanded of chambers, for instance, insofar as being strong, durable, and inhibiting the infiltration of soil into the interior of a string of chambers. It must be economical and easy to use.

SUMMARY

An object of the invention is to provide leaching chambers and other kinds of arch shape cross section chambers with means for inter-connecting at a variety of selected angles, according to the need of the installer in the field. A further object is to provide a swivel connection means that is economic, rugged, and reliable, that keeps the mated chambers from separating, that inhibits the infiltration of soil into the chamber interior, and that minimally compromises the exterior surface area of the chamber which is used for percolating water into the media surrounding the chamber.

In accord with the invention, means which enables connection of one chamber with another, with a selected horizontal plane angle, includes a coupling comprised of spaced apart end domes; and, chambers with detachable or integral end domes.

In accord with one aspect of the invention, a coupling for a chamber is comprised of two spaced apart domes, with a connector running therebetween. Each dome is adapted to receive either a chamber having a suitably shaped and overlapping dome end, or the interior end of a corrugated chamber, i.e., one with peaks and valleys. The chambers can be swiveled in the horizontal plane about the domes of the coupling and thus relative to each other, to achieve a desired angling between chambers. In one embodiment, the coupling has a 45 degree elbow shape connector; and, reversing the engagement of such a coupling with a first chamber provides a range of angling of the second chamber which can range up to 180 degrees. In another aspect of the invention, apparatus comprising two chambers and a coupling are disposed relative to one another so that the water flow path from one chamber, through a coupling, and through the other chamber follows a zigzag course. Thus, a jog in a string of chambers is attained, and an obstruction such as a boulder may be avoided.

In accord with the invention, a dome of the coupling comprises a sidewall which is a portion of a conical section. The dome conical section fits the contours of the peak and valley shape interior of a corrugated chamber, so that motion to and from the coupling is thereby prevented. In an alternate embodiment, a pedestal at the top of the dome engages a feature at the top interior of the chamber, to prevent motion of the chamber toward the coupling, while motion in the opposite direction is inhibited by the rib-to-sidewall engagement. The coupling, and other embodiments of the invention having like domes, is adapted to receive and connect chambers and portions of chambers, where there is variation in lengthwise dimension of the internal chamber features that are engageable by the dome.

In accord with another aspect of the invention, an adapter for a chamber comprises an endplate portion, for attaching the adapter to the end of a chamber, a dome part functioning generally as just described, and a smaller width connector running between the endplate and dome. In one embodiment, the dome part has a thin wall and absence of ribbing. Thus, in use the dome of one adapter is overlapped onto the dome of an identical adapter, so chambers can be connected with the desired angling.

In still further accord with the invention, a dome part is integral with the end of a chamber. In one embodiment, one end of the chamber comprises a dome portion, which is shaped to be overlapped by the slightly larger dome portion at the opposing end of a like chamber. In a preferred embodiment, the dome comprises a portion of a conical section, i.e., a portion of a surface of revolution, the vertical plane curve of which is congruent with, or identical to, the curve of the arch shape cross section of the chamber. For instance, when the chamber has a semi-ellipse cross section, the dome comprises is a portion of a semi-ellipsoid. In another embodiment, the chamber has a dome section at one end, and an ordinary chamber end at the opposing end; and when like chambers are connected a of swivel angle from zero to 20 degrees (plus or minus 10 degrees) is obtained. In many embodiments of couplings and chambers, the dome tops may have pinning means to hold mating dome parts together.

The foregoing and other objects, features and advantages of the invention will become more apparent from the following description of preferred embodiments and accompanying drawings.

DESCRIPTION

The invention is used for connecting together leaching chambers and other devices presenting the same needs. The invention is described in terms of molded plastic chambers of the type shown in U.S. Pat. No. 5,551,903 and U.S. Pat. No. 5,401,116; and in terms of chambers shown in co-pending U.S. patent application Ser. No. 09/849,768 filed May 4, 2001 (and corresponding Published Application No. 20020044833), and Ser. No. 10/402,414, filed Mar. 28, 2003, both by Kruger et al., all the foregoing having commonly controlled assignee. The disclosures thereof, and of provisional patent application Ser. No. 60/382,144 filed May 20, 2002, are hereby incorporated by reference.

The invention is described in terms of a coupling first, and then in terms of chambers having detachable and integral ends, since the principles for all embodiments are emphasized in the description of the coupling.

A commercial chamber for which an embodiment of the present coupling invention is useful is an Equalizer® 36 leaching chamber. (Infiltrator Systems, Inc., Old Saybrook, Conn. 06475, U.S.) Such typical chambers are injection molded of plastic. They have an arch shape cross section, an open bottom, and corrugations comprised of peaks and valleys. The sidewalls are perforated with slots 43. See the fragment of a chamber 42 in FIG. 4, and the drawings of the referenced patents. Other design chambers that have general similarities in design are sold in commerce and described in patents; and, the essential invention may be used for them as well. While the invention is described in terms of leaching chambers it is within the scope of the invention to use the invention for other purposes to which molded arch shape chambers have been put, or may be put, including handling stormwater, draining golf course sand bunkers, and other uses involving the creation of a void in the earth.

Figure 1:
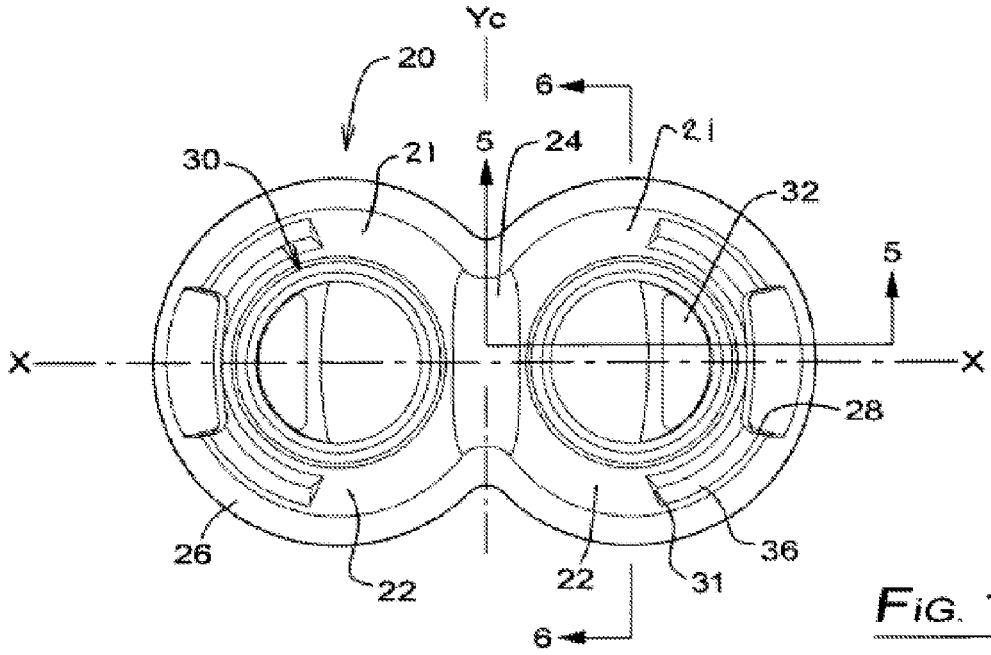
FIG. 1 is a top view of a straight coupling comprised of two domes.

FIG. 1 is a top view of straight coupling 20. The coupling is comprised of spaced apart hollow domes 22. The interiors of the domes are joined together by connector 24, which is an arch shape conduit for flowing water from one dome to the other. The coupling is symmetrical on either side of a central y-z plane, running along central y axis, $y_c$. Opening 28 in the sidewall of dome 22 enables water from the chamber to enter the dome, to flow through the connector, into the opposing dome, and then into the mating chamber. Other shape openings, e.g., a series or perforations, may be used. The placement of the openings is circumferentially limited, as will be appreciated below, so the opening, and an entry for soil, is not exposed when a chamber is swiveled to its maximum angle. A base flange 26 circumscribes the bases of the domes and connector, to provide support on the soil. The dome sidewall is a portion of a truncated conical surface, so that the mating chamber or other object can swivel about the portion. Preferably, the conical surface is part of a frustum of right circular cone. Generally, inward tapering surfaces of revolution generated by other than straight lines may be used within the scope of conical surface, conical section, or conical portion, as the terms are used herein. For instance, in the embodiment of FIG. 13 the conical surface is a portion of a truncated semi-ellipsoid.

Figure 2:
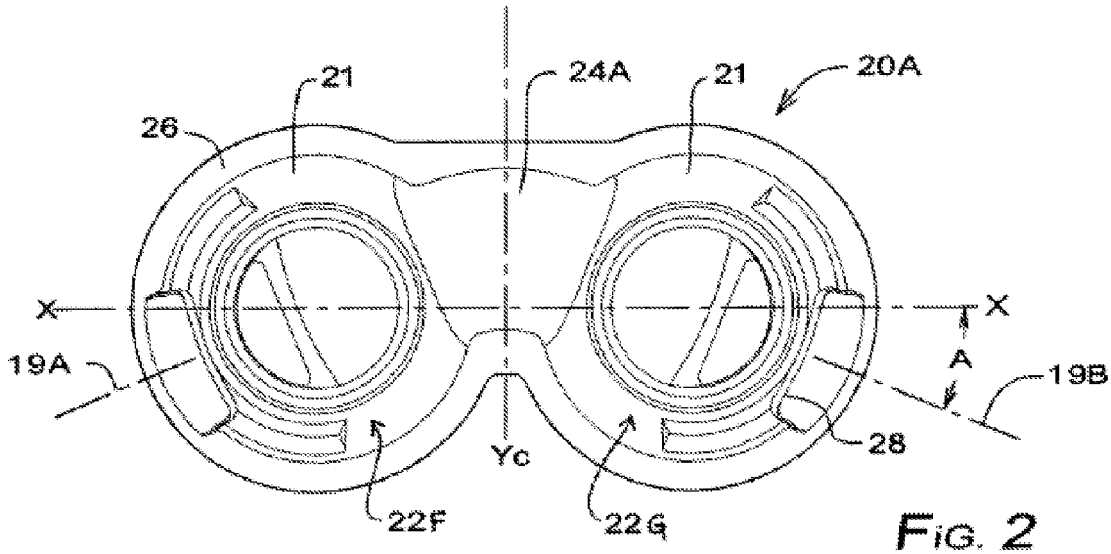
FIG. 2 is a top view of an elbow coupling.
Figure 3:
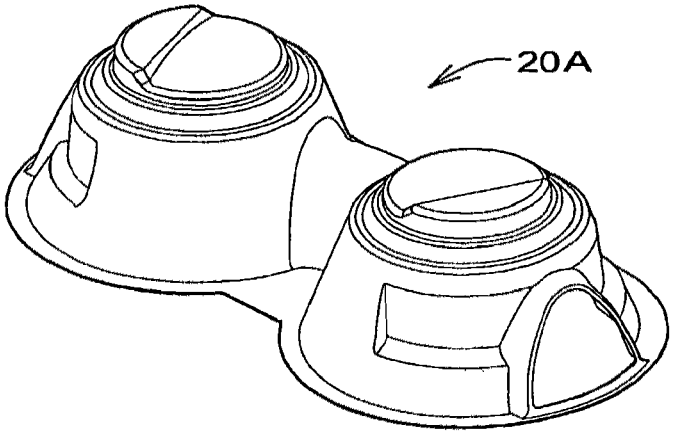
FIG. 3 is a perspective view of an elbow coupling.

FIG. 2 is a view like the view FIG. 1, showing elbow coupling 20A. The difference between straight coupling 20 and elbow coupling 20A is that the domes 22F, 22G lie along axes 19A, 19B running at opposing angles A, preferably 22.5 degree angles, to the longitudinal x axis. FIG. 3 is an isometric view of connector 20A. (Where suffixes are used with numerals in this description, they will be understood as referring to portions which correspond with earlier-mentioned features.)

Figure 4:
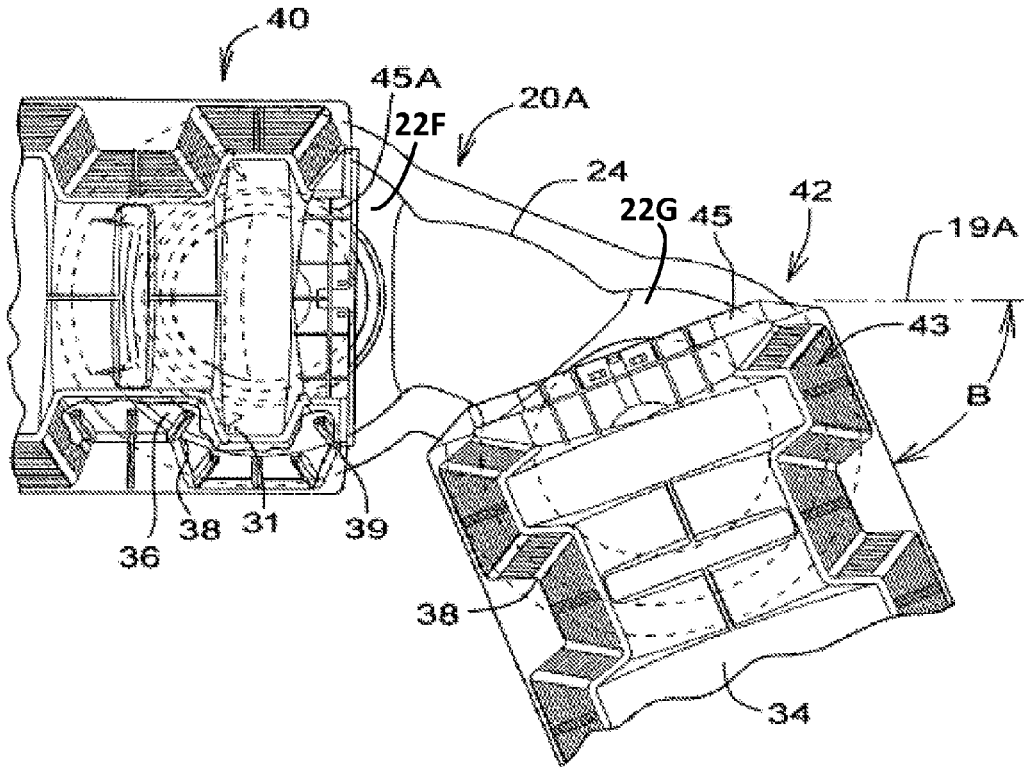
FIG. 4 is a top view of an elbow coupling engaged with two chambers, one of which is partially cutaway to show one of the domes.

To give better meaning to the details of the construction, the use of the coupling will be first described. The top view of FIG. 4 shows how the ends of two identical leaching chambers 40, 42 are connected by elbow coupling 20A, with their longitudinal axes at a selected angle in the horizontal plane. The "skin" of the end of leaching chamber 40 is partially cut away, so the details of the underlying coupling are visible.

The end of each chamber overlaps a dome 20F, 20G in a manner that prevents it from moving significantly in the lengthwise or lateral chamber direction. See FIGS. 4-7, discussed further below. The fit between a chamber and the coupling permits the chamber to pivot about the dome. The coupling is referred to as a swivel coupling (reflecting the commercial product appellation). But, as will be appreciated there is no swiveling action during use, except perhaps for a bit of motion, as the precisely desired angling as achieved, when the chambers are being installed. Thus, within the angle range which an embodiment's particular design allows, either chamber 40, 42 can be positioned at a desired angle relative to the coupling, and thus relative to the other chamber.

In one embodiment, the domes are designed to allow nominal plus or minus about 22.5 degree angle of motion of the chambers relative to the coupling. Thus, with a straight coupling 20, the angle between the longitudinal axis of one chamber and that of the mating chamber chambers can be varied in the nominal range minus 45 degrees to plus 45 degrees. With elbow coupling 20A, the angle between the chambers can be varied in the range 0 degrees to 90 degrees, as suggested by angle B in FIG. 4. When the chambers are at 0 degree, or parallel, the presence of the elbow coupling means that there will be a small zig-zag along the length of the string. This can be desirable in some installations.

FIG. 4 shows the chambers at a 67.5 degree angle to each other. In FIG. 4, chamber 40 may be rotated 22.5 degrees more, downwardly, relative to the coupling axis 19A. That will achieve a 90 degree angle between the chambers.

In another aspect of the invention, a range of angling is achieved by changing the way in which coupling 20A is used, from a first mode to a second mode. Suppose coupling 20A is removed from engagement with the chambers as shown in FIG. 4, is rotated 180 degrees in the horizontal plane, and re-engaged with an un-moved chamber 40, so that dome 22F, instead of dome 22G is captured within chamber 40. Thus, the coupling will now angle upwardly in the Figure. Then, suppose chamber 42 is engaged with the now-free dome 22G. With the re-connection, there will be a range of chamber angling which mirrors angle B, i.e., there will be swiveling from 0 to minus angle B, in the drawing. Thus, the one elbow coupling 20 permits a range of angling between connected chambers of plus or minus 90 degrees between chambers. In the generality of the invention, other connector shapes may be used in like fashion.

The angle of motion of a coupling may be made lesser or greater than the plus or minus 22.5 degrees. The maximum angle of rotation of a chamber about a coupling axis 19A, 19B is limited by interference of the flange 45, 45A at the end opening of the chamber with the walls of the connector 24. Thus, the range of angle can be varied by changing the dimension of the connector 24 or placing a stop on the coupling, to limit motion, prior to the connector being hit. As a general proposition, it is desirable to keep the coupling compact. However, the length of the connector 24 may be made larger than the Figures suggest.

Figure 5:
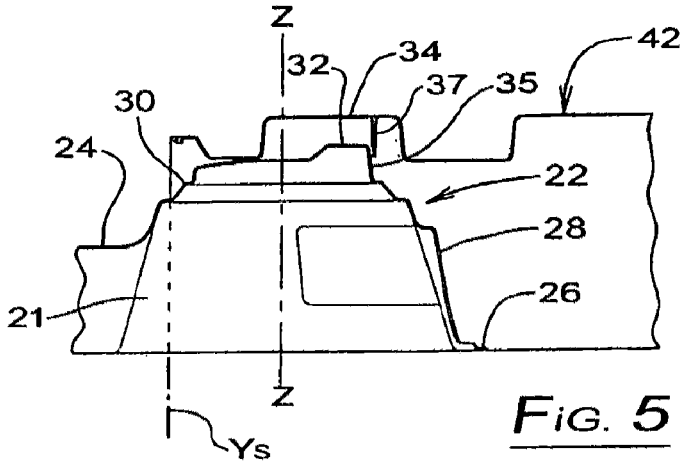
FIG. 5 is an elevation center plane cross section of a chamber engaged with the dome of a coupling, where then chamber has a cut end.
Figure 6:
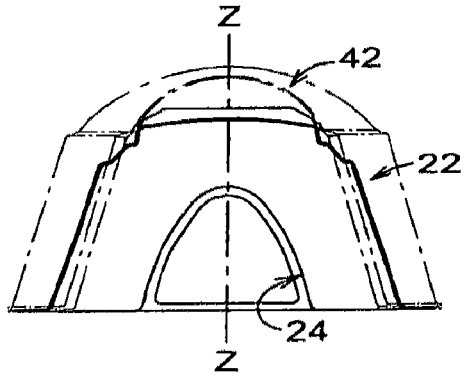
FIG. 6 is a vertical cross section through a dome of FIG. 1, showing how a chamber in phantom engages the coupling.
Figure 7:
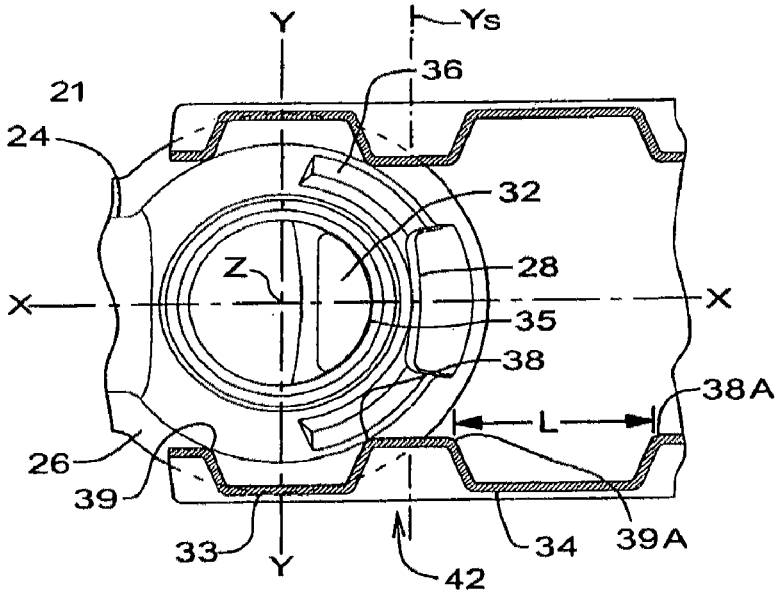
FIG. 7 is a top view showing how a chamber, cut away in horizontal cross section, engages the dome of a coupling.

Refer now again to FIGS. 1-3, as well as to FIGS. 5-7. FIGS. 5 and 6 show center line cross sections of a dome, respectively looking along the y and x axes. The sidewall of dome 22 of a coupling fits closely with the chamber interior during use, to inhibit soil movement through the space between the dome and the chamber. The sidewalls of the dome engage the sidewalls of the chamber as described below. The top partial cutaway views of FIGS. 4 and 7 show how a coupling dome preferably is engaged with a chamber 42 having an end peak corrugation 34. The chamber 42 in FIG. 7 is shown as it appears when cut away through a horizontal plane, just above the chamber base flange. The upward sloping interior corner surfaces, 38, 39 of the peak corrugation 33 fit the conical sidewall of the dome, with sufficient clearance to allow the swiveling which is described, while at the same time limiting lengthwise and lateral motion of the engaged parts.

The top 30 of the dome comprises a series of circumferential steps. The steps provide rigidity to the top. Principally, they are intended to achieve a close fit of the dome top 30 with the interior surfaces of the chamber. This is partially illustrated by FIG. 5. A typical strong chamber has much internal ribbing, thus accounting for the multiplicity of steps. In the generality of the invention, the dome top may be open, although that is less good for strength.

The top 30 comprises a pedestal 32, which when viewed vertically down, has the shape of a chordal segment of a circle. See FIG. 7. The pedestal is symmetrically positioned in a location nearest to the centerline of opening 28, which is centered within a chamber when the chamber is at its central position of plus or minus swivel rotation relative to the coupling. The pedestal is a means for engaging a feature of the chamber, which is proximate the interior top of the chamber. It prevents lengthwise motion of a coupling toward the chamber, particularly when a cut portion of a chamber rests on the dome, as described just below.

Figure 9:
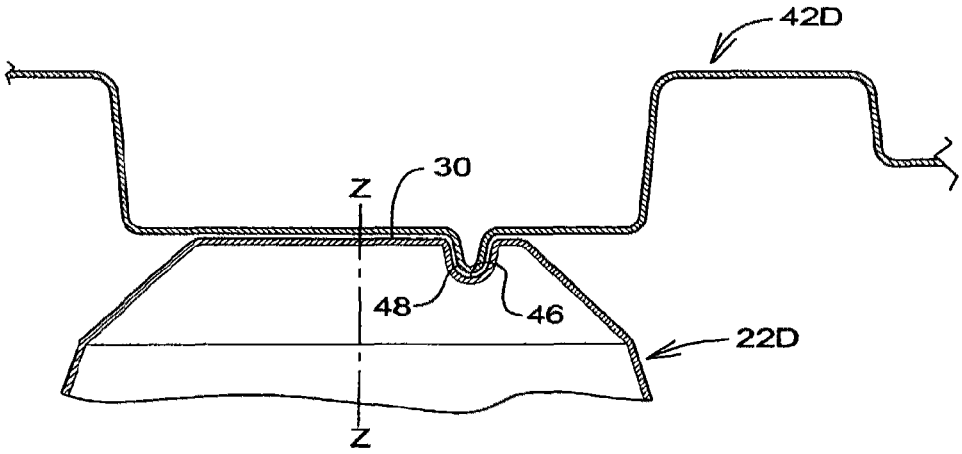
FIG. 9 shows in vertical side cross section how a dome having a depression is engaged by a chamber.

With reference to FIG. 7, suppose chamber 42 is shortened by severing along a vertical plane that includes axis $y_s$. When the cut end of the chamber is then laid over the dome, and the peak corrugation 34 embraces the dome, the fit between the inner corners 39A and 38A of the peak are not so good. This is because, as in many typical chambers, the peak corrugation 34 and other peak corrugations away from the chamber end have greater lengthwise dimension L than does end peak corrugation 33. Pedestal 32 on the dome accommodates the situation. The outer edge 35 of the pedestal engages rib 37 or some other feature extending downwardly from the interior top of the chamber. See FIG. 5. In an alternate embodiment, the pedestal engages the far end of the interior of the top of the peak corrugation 34. The curved outer surface 35 of the pedestal enables achievement of the desired chamber swiveling motion. FIG. 9 shows an alternate embodiment, where the top 30 of dome 22D has an arc shape depression in substitution of the upward extending chordal pedestal, to engage a downward extending protuberance, such as a pin, 48 of chamber 42D.

In use, chambers are subject to vertical loads. For instance, a motor vehicle may pass over the surface of soil above a buried chamber. In resisting such, the end of a chamber is weak compared to the middle of a chamber. Thus, when ordinary chambers are joined together as a string, the joints between chambers are configured to transfer load from the end of one chamber to the end of the adjacent chamber. Obviously, the presence of a coupling interferes with such load transfer. The dome which is described here is particularly strong, and effective in providing vertical support to the end of a chamber when it deflects under load. Load from a deflecting end of a chamber is transferred to the dome top, down the sidewalls, and through the base flange to the soil.

A coupling and chamber combination may intentionally be configured so a pedestal on the dome is required for an uncut chamber. In such embodiment, the dome diameter is smaller relative to the chamber peak corrugation, than is shown in FIG. 7. The conical section portion of the dome engages interior corner surface 39, but is too small to simultaneously engage interior corner surface 38. Thus, the engagement of a dome and chamber will be like that described for a cut chamber, where the dome engages peak corrugation 34.

Other shape pedestals can be used to achieve the foregoing purposes. For instance, the pedestal can comprise a multiplicity of spaced apart pins, or a curved circumferential rib. In an alternative embodiment, shown in the fragmentary view of FIG. 9, a chamber 42D has a downward protruding feature, such as a pin 48. And, the means for preventing longitudinal movement of the top of the dome 22D comprises curved depression 56, shaped to engage the downward protruding pin.

In recapitulation, longitudinal motion of a chamber, to and away from a coupling, is thus prevented by the design. The chamber is prevented from moving away from the coupling by engagement, i.e., by interference fit, of the dome sidewalls 21 with interior corner surfaces 39, 39A of the peak corrugations, according to which "bay" of the chamber within which the dome is positioned. This mode of engagement is very strong, with respect to preventing separation of the chambers against any forces that might pull them apart lengthwise. The chamber is prevented from moving toward the coupling (to the left in FIG. 5 or 7) by either engagement of the dome sidewall 21 with the interior peak corrugation surfaces such as 38, 38A, or by means of the surface of edge 35 of pedestal 32, according to the design option that is chosen.

The invention coupling is advantageous in that, when it has a pedestal, it can be constructed so that it is suited to engage two different width peak corrugations, or with two different sets of features which prevent motion of the chamber toward the coupling. This makes the one design coupling suited for unaltered chambers or cut chambers, or for two different design chambers.

With the invention coupling, the manner of coupling-chamber engagement is independent of the configuration of the end flanges 45, 45A, by which chambers are ordinarily mated. As mentioned, it is common to have chambers connect to each other by means of overlapping and certain types of latches. Thus, the configuration of the opposing end flanges can differ, being characterized as overlapped or overlapping, male or female, etc. In the invention, one coupling design fits either end of the chamber.

The conical sidewall 21 of the preferred dome has a depression 36. See FIG. 4 and FIG. 7. The depression extends laterally partway around the dome, from the edge of opening 28, to near the transverse centerplane of the dome. Given the close fit between the chamber and corner or surface 38, depression 36 facilitates water flow past the corner of surface 38, to ensure there is good water flow out the perforations of the end peak, when the chamber is sharply angled relative to the coupling, although normal tolerances and clearances probably are sufficient. The vertical length of the depression as it runs along the sidewall can be less or more than shown in the Figures. The depression does not extend the whole slant height of the sidewall, so there is still good engagement, to inhibit lengthwise relative motion. In an alternative embodiment, the fit between the dome portion and the chamber may be quite loose, and geotextile may be laid over the joint, to inhibit entry of soil into any gaps where parts mate. Similarly, since the circumferential extension of the depression, toward connector 24 is limited, so it does not undercut the close fit between the sidewall 21 and the interior corrugation edge surface 39, when the chamber is swiveled to its maximum extent, e.g., when chamber 40 shown in FIG. 4 rotates upwardly relative to the coupling 20A, the edge surface 39 will not move along the dome sidewall 21 so far as to reach the closest edge 31 of the depression 36.

In the generality of the invention, an elbow coupling need not be entirely symmetrical about the central z-$y_c$ plane, like a preferred embodiment. The connector of a coupling may have different lengths on either side of the plane. Also, one dome may have a different dimension than the other, to accommodate joining together different size, shape or type of chambers.

Figure 8:
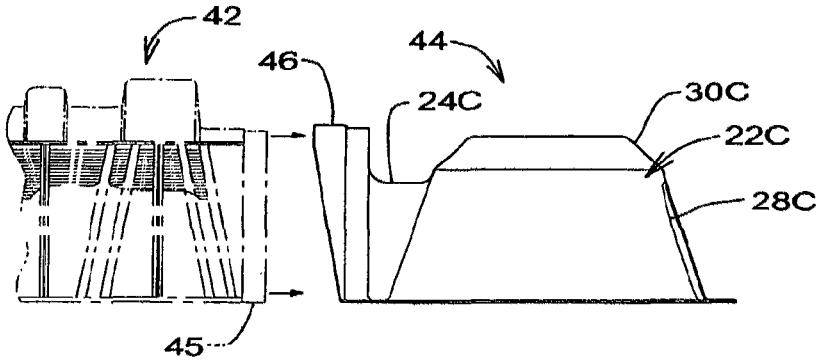
FIG. 8 is a side view of coupling comprised of a dome with end plate, along with a mating chamber, shown in phantom.

FIG. 8 illustrates another embodiment. Coupling 44, also called an adapter, comprises a single dome 22C having top 30C and endplate 46. The dome 22C is joined to endplate 46 by connector 24C. The end plate is shaped to engage the end of a chamber 42, shown in phantom, such as by slip-fit overlap or underlap of the end of the chamber, or by attaching in the manner associated with a common chamber endplate. See U.S. Pat. No. 5,839,844, which is hereby incorporated by reference for what it teaches about endplate attachment. In use of the FIG. 8 embodiment, another chamber captures the dome 22C in the same way as has been described for the capture by a chamber of dome 22 of coupling 20.

Figure 10:
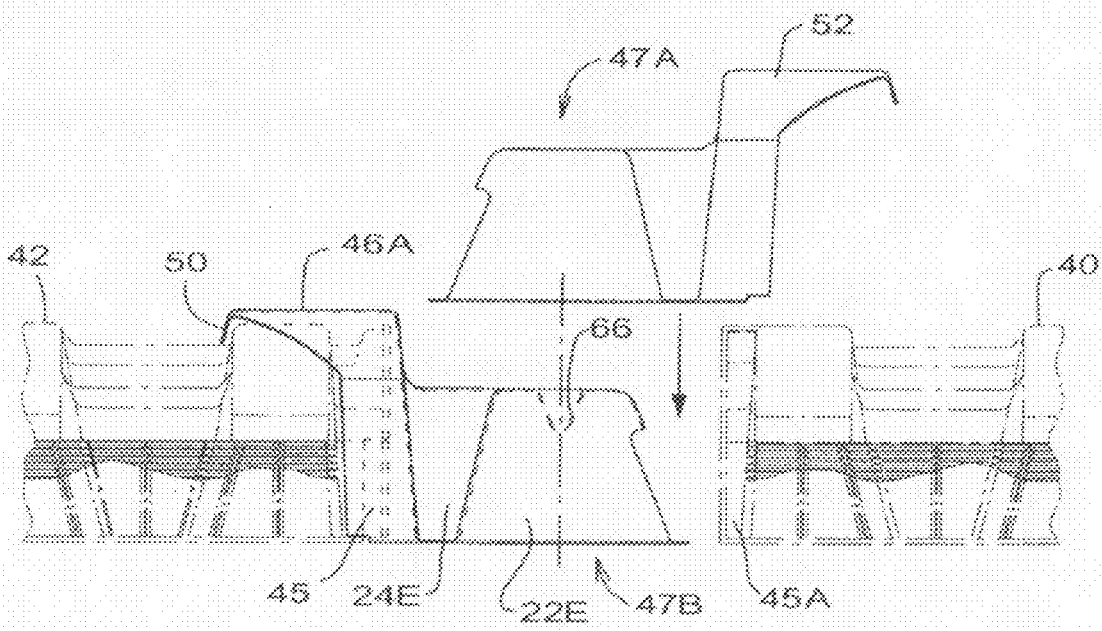
FIGS. 10 and 11 shows chambers wherein two identical coupling adapters are connected to the otherwise-mating chamber ends.
Figure 11:
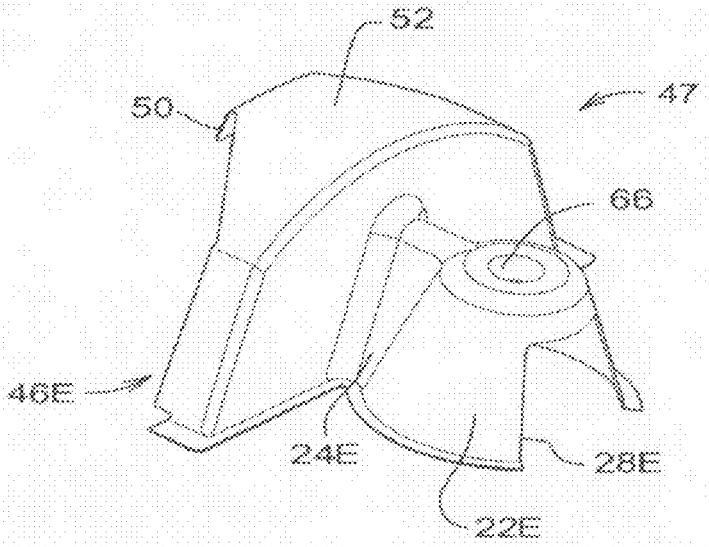

FIGS. 10 and 11 show still another embodiment of the invention, two virtually identical pieces, 47A, 47B, of which are pictured. The Figures show how couplings 47A, 47B enable chambers 42 and 40 to be adapted for connection in swivel joint fashion. In the FIG. 10, the chambers 40, 42 are oriented as they would be if they mated in the absence of use of the coupling. Thus one chamber end will be slightly larger than the other end, so they can be engaged in overlapping fashion.

Coupling 47A comprises an endplate portion 46E, which is suited for overlapping either end of either chamber. This is accomplished by having an endplate-to-chamber fit that is sufficiently large to accommodate the differences in dimension of the opposing ends of the chamber. A tang 50 on the top 52 of the endplate portion engages a feature on the top of the chamber, such as the edge of a corrugation, to keep the flange from coming off the chamber once it is slipped over the end of the chamber. Thus, the design of the endplate enables the same configuration of coupling 47A, 47B to be used at either end the overlapping or overlapped end of a chamber.

As illustrated by the vertical arrow in FIG. 10, the dome of the first coupling 47A, which engages chamber 40, slips over the top of the dome of the second coupling 47B, which is engaged with chamber 42. The domes of couplings 47A, 47B have smooth interiors and the walls are comparatively thin, relative to the overall dimension of the dome. Thus, either dome can nest on top of, and swivel about, the other. Alternatively, the overlapped dome is slightly smaller in dimension than the overlapping dome, for better fit, although this goes contrary to the aim of minimizing inventory requirements of users. The domes optionally have a downward projecting "tapered pin" 66, molded into their tops, to provide enhanced positive engagement of the mating couplings.

Each dome of coupling 47A, 47B has an opening 28E, to enable water to flow during use, from one dome to the other, and thus from one coupling and chamber to the other. In an alternative embodiment, the connector 24E, running between the endplate portion 46E and the dome 22E, can have an elbow shape, so the basic angle of the coupling is biased one way or the other, consistent with the description above about the two-dome couplings. When the term connector is used to describe a chamber having an integral (coupling type) end, as follows for FIG. 12, the term refers to the portion of the article which runs between the arch shape cross section of chamber or adapter, proximate the end of the chamber, and the dome portion. The connector will have a narrower width than the width of the maximum width of the conical portion of the dome.

Figure 12:
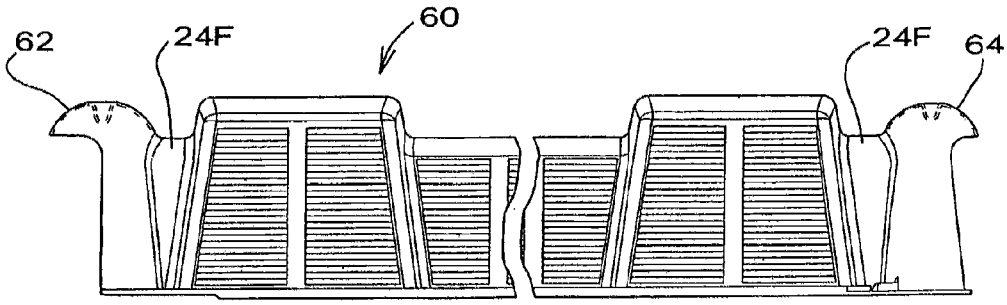
FIG. 12 shows in side elevation a chamber having opposing integral endplates, connectors and domes, wherein a first end dome is shaped to slip fit on top of the opposing end dome of a like chamber.

FIG. 12 shows in vertical side elevation another style chamber 60, with the center portion cut-away. The chamber has opposing ends with integral endplates, connectors 24F, and domes 62, 64, consistent with the embodiment shown in FIGS. 10 and 11. The domes engage in a manner like that described for that other embodiment. Since the domes are integral, it is practical to make the dome 64 slightly larger in dimension than dome 62, so it is always the overlapping dome when the chambers are engaged.

Figure 13:
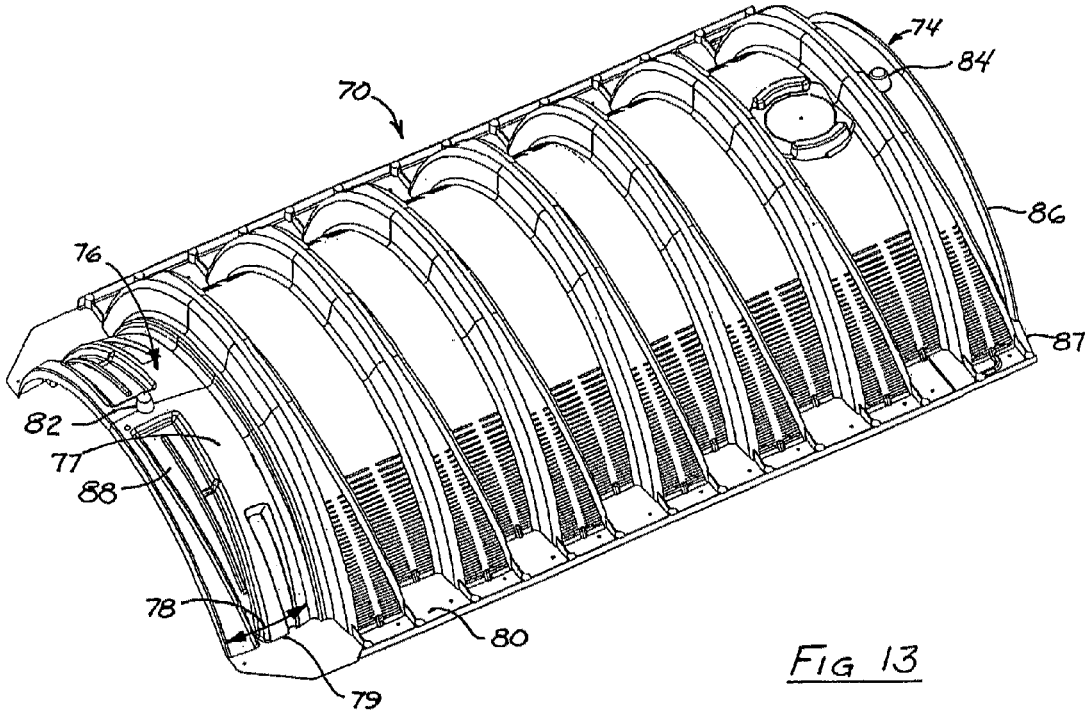
FIG. 13 is a top perspective view of a truncated semi-ellipse cross section chamber having a comparatively small conical section dome at one end, and a plain opposing end.

FIG. 13 is a perspective view, looking downwardly on chamber 70. The chamber has a peak and valley configuration like that described in the aforementioned application Ser. No. 09/849,768. The arch shape cross section of the chamber has the geometry of a truncated semi-ellipse, and the corrugations are shallower and closer together than in earlier configuration chambers. Preferably, the chamber has an about 4 foot (1.2 m) length and an about one foot (30 cm) center height.

Chamber 70 has a dome end 76 and an opposing "ordinary" end 74. By ordinary end is meant the kind of end normally associated with chambers of the prior art, that is, an end without any dome shape or conical section. The ordinary end has a curved cross section, and comprises a portion, often referred to as an end flange in the prior art, which is suitable for overlapping another chamber. In chamber 70, the ordinary end 74 is shaped to overlap and mate in swivel fashion with the dome end. The end 74 has a curve geometry which is nominally identical to, or generally congruent with, the curve of the inside edge of the peaks (i.e., the curve of the valleys) of the main body of the corrugated chamber. So, when identical chambers are mated, the interior of hollow molded pin 84 rests on top of molded pin 82, and keeps the chambers from separating. Dome end 76 has a portion 77, which is a portion of a conical section. In chamber 70, the dome is much less pronounced, compared to other embodiments, which have been described, since the design range of angle of swivel for the product is limited, and it is an aim to keep the length of the end joint sections compact for structural and sidewall leaching area reasons.

The curve of dome end 76 in the horizontal plane is evident in the Figure, at the intersection 79 of the bottom of the dome sidewall with the horizontal flange 80 of the chamber base. The range of motion of the outer edge 86 of end 74, when it overlies end 76, is indicated by the double-headed arrow 78. Interference between the lower end of the edge 86 with the first arch at end 76 limits maximum rotation; and thus the corner 87 of the base flange 80 is angled in the horizontal plane. Preferably, the arc of rotation 78 of two mated chambers relative to each other is in the range 10-30 degrees, most preferably about 20 degrees, i.e., plus or minus 10 degrees. This compares with the range of up to 6 degrees for prior art chambers having ordinary and somewhat less assured end joint configurations.

The conical section portion 77 of end 76 is characterized by an inward curving sidewall, as viewed in the vertical cross section plane of the chamber. The conical section portion 77 is shaped to match the path which is followed by the edge 86 (or some other nominally similar interior structure on the inside of the end 74) when the end 74 of a like chamber is mounted on and rotated about pin 82. In context that there is ordinary provision for clearance and variation, there is line contact, or near-line contact, between the end 74 and the surface of the conical section of end 76. So, entry of soil into the interconnected chambers will be inhibited, and some load may be transferred from end 74 to end 76.

In chamber 70, the conical dome, has a curving sidewall which is congruent with, and which preferably matches, the curve of the cross section geometry of the chamber body. Thus, the conical section 77 transitions directly into the first peak at end 76; and, there is no connector as such, as in some other designs. The second end 74 of chamber is shaped for fit with a chamber or other item that does not have a conical shape portion. Thus, it conveniently accepts an endplate, to close off the end of the chamber, when it is the last chamber in a string, or to enable water to flow to or from the chamber through a pipe passing through the endplate. The end 74 has an upward extending flange running along the edge 86. The top end of end 74 is sloped outwardly (to the right in FIG. 13), so the end lies nominally in a cross section plane that is sloped at about 6 degrees from the vertical.

In an alternate embodiment, the interior of end 74 may be shaped with a conical section that mates with the conical section of dome end 76, when end 74 is overlapped on end 76. The molded in depressions 88 provide strength. They are shallow and do not allow significant ingress of soil at the joint. Other strengthening features may be used. For clarity of illustration here, and throughout this description, small ribs, injection molding feeding channels, sprues, etc. have been omitted. In the generality of this and other embodiments the pin or pivot interconnection at the top of the conical section might be omitted, and other means for keeping the chambers mated may be employed, such as screws driven through the joints of mated parts in the field, adhesives or sealants, etc.

In an example of how the multiplicity of embodiments might work together: The second end of a first chamber 70 is overlapped by the first dome end of a like second chamber 70, and the chambers lie at an angle to each other. A single-dome coupling 44 is attached to the second plain end 86 of second chamber 70. The first end of a third chamber, from the prior art overlays the coupling 44. The second end of the third chamber overlays the first dome of a coupling 20. A fourth chamber, also from the prior art, overlays the second dome of coupling 20. In a still further variation, a chamber 60 overlies the dome of a suitably shaped coupling 44, which is connected to the first end of the first chamber. While it would be quite unusual to have such a combination in practice, the example illustrates the inter-relatedness of the inventive devices.

The couplings and chambers of the invention may be made in various ways and of various materials. They may be molded of injection molded polypropylene, high density polyethylene (HDPE) or other suitable commercial plastic. Less preferably, the invention components may be molded from vacuum or thermoformed sheet plastic sheet. In special cases they may be made of materials other than plastics. The coupling 20 and any configuration described above where wall thickness is not a limiting factor may advantageously be made of expanded polystyrene or other structural foam material, for economic low volume production. Except where indicated, or where it is obvious, that thinness is required, a thin wall coupling may have interior stiffening ribs and gussets, etc., in accord with known art.

As described, the invention is most suitable for use with arch shape corrugated chambers. The term is intended to encompass chambers which have various cross section geometries, as are described in the reference documents. For example, the arch shape cross section geometry may be a regular or irregular section, a continuous or discontinuous curve, etc. While a corrugated chamber is dictated by economics and properties of commercial plastic materials, various embodiments of the invention can be used with chambers which are not corrugated. While the coupling is best used for engaging the interior of chambers, in other applications the coupling may be used in combination with chambers having dome ends or adapters, i.e., having plain ends with couplings attached. While such have been described in terms of straight connectors, bent connectors may be used.

Although this invention has been shown and described with respect to a preferred embodiment, it will be understood by those skilled in this art that various changes in form and detail thereof may be made without departing from the spirit and scope of the claimed invention.

What is claimed is:

1. An article for receiving or dispersing liquids when buried in soil, the article comprising:

a chamber for containing a liquid, wherein said chamber includes a chamber body portion positioned between a first chamber end portion and a second chamber end portion, wherein each of said first chamber end portion and said second chamber end portion has an opening communicated with said chamber body portion, said first chamber end portion having a first molded pin, and being domed shape for pivotably connecting with a second chamber end portion of a like chamber, wherein said first chamber end portion includes a conical section portion that is curved inwardly toward said chamber body portion; and said second chamber end portion being sized to overlap the first chamber end portion of a like chamber and having a hollow second molded pin configured to pivotably contain said first molded pin to form a pivotable joint therebetween to allow said chamber and said like chamber to pivot in the horizontal plane relative to each other when said chamber is associated with said like chamber.

2. The article of claim 1, wherein when said first chamber end portion and said second chamber end portion of a like chamber are associated such that a portion of said second chamber end portion of the like chamber overlaps a portion of said first chamber end portion, said first molded pin is disposed within said hollow second molded pin to allow horizontal pivoting of the like chambers relative to each other but to inhibit the longitudinal movement of the like chambers relative to each other.

3. The article of claim 1, wherein said first molded pin is a molded pin or pivot disposed at the top of said first chamber end portion and said hollow second molded pin is a molded pin or pivot disposed at the top of said second chamber end portion.

4. The article of claim 1, wherein said second chamber end portion is shaped for overlapping said first chamber end portion of said like chamber.

5. The article of claim 1, wherein said first chamber end portion includes a sidewall substantially shaped as a portion of a conical section for receiving thereon an interior portion of a second chamber end portion of said like chamber.

6. The article of claim 5, wherein said chamber body portion is arch shaped and includes a continuous curve arch shaped geometry.

7. The article of claim 6, wherein the curve of said conical section in the vertical plane is generally congruent with said chamber body portion.

8. The article of claim 6, wherein a cross section of said continuous curve has the geometry of a truncated semi-ellipse and wherein a cross section of said conical section is a portion of a semi-ellipsoid.

9. The article of claim 1, wherein when said chamber is mated with said like chamber, each of said chamber and said like chamber is able to pivot about a predetermined range in the horizontal plane relative to the other of said chamber and said like chamber.

10. The article of claim 9, wherein said predetermined range is between 1 and 20 degrees.

11. A chamber for receiving or dispersing liquids when buried in soil, the chamber comprising:

a chamber for containing a liquid, wherein said chamber includes a first chamber end portion and a second chamber end portion separated by a chamber body portion, wherein each of said first chamber end portion and said second chamber end portion has an opening communicated with said chamber body portion, said first chamber end portion being domed shape for pivotably connecting with a second chamber end portion of a like chamber, wherein said first chamber end portion includes a first arched shaped cross section having a first cross section geometry and a second arched shaped cross section having a second cross section geometry, wherein said first cross section geometry is larger than said second cross section geometry, said second cross section geometry being positioned between said first cross section geometry and said chamber body portion; and said second chamber end portion being sized to overlap the first chamber end portion of a like chamber to form a pivotable joint therebetween to allow said chamber and said like chamber to pivot in the horizontal plane relative to each other when said chamber is associated with said like chamber.

* * * * *